United States Patent [19]

Graf

[11] Patent Number: 4,886,178

[45] Date of Patent: Dec. 12, 1989

[54] METHOD AND APPARATUS FOR PACKAGING, SHIPPING AND USING POISONOUS LIQUIDS

[75] Inventor: Hans-Juergen Graf, Oceanside, Calif.

[73] Assignee: Air Products and Chemicals, Inc., Allentown, Pa.

[21] Appl. No.: 259,934

[22] Filed: Oct. 19, 1988

Related U.S. Application Data

[63] Continuation of Ser. No. 188,089, Apr. 27, 1988, abandoned, which is a continuation of Ser. No. 944,189, Dec. 22, 1986, abandoned.

[51] Int. Cl.[4] ..... B67B 5/00; B67B 7/24

[52] U.S. Cl. ..... 215/247; 220/277; 222/83.5; 53/471; 137/318; 137/322; 206/524.5

[58] Field of Search ..... 206/524.5, 524.6; 215/247, 250, 257, 324, 341, 347; 220/207, 277; 222/1, 5, 83, 83.5, 91; 137/318, 322; 53/471

[56] References Cited

U.S. PATENT DOCUMENTS

| | | | |
|---|---|---|---|
| 1,189,465 | 7/1916 | Mayo | 215/247 |
| 2,091,737 | 8/1937 | Longway | 215/247 X |
| 2,114,583 | 4/1938 | Adams | 137/318 |
| 2,200,600 | 5/1940 | Grapp | 215/247 |
| 3,438,656 | 4/1969 | Fritch | 137/318 |
| 3,463,339 | 8/1969 | McGuckin | 215/247 |
| 4,298,037 | 11/1981 | Schumacher et al. | 141/1 |
| 4,582,207 | 4/1986 | Howard et al. | 215/247 |

*Primary Examiner*—Stephen Marcus
*Assistant Examiner*—Nova Stucker
*Attorney, Agent, or Firm*—James C. Simmons; William F. Marsh

[57] ABSTRACT

A bubbler container for containing and transporting ultra-pure corrosive and poisonous liquid reagents which must be protected from exposure to air and from transmission of gas or vapor through containment walls, means for using the same in connection with unique valving and multiple layer seals for conduits is disclosed.

11 Claims, 1 Drawing Sheet

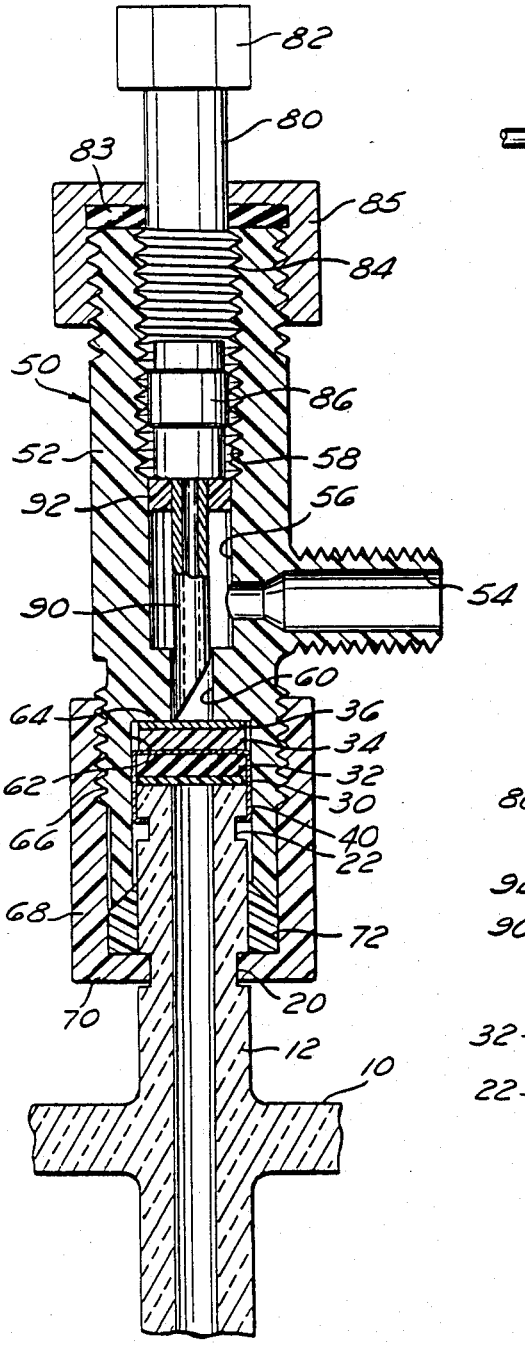
Fig. 2
Fig. 1
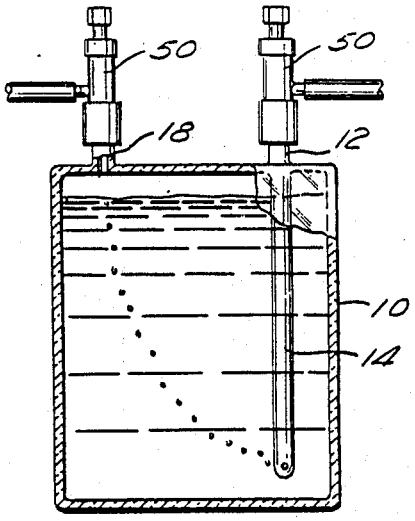
Fig. 3
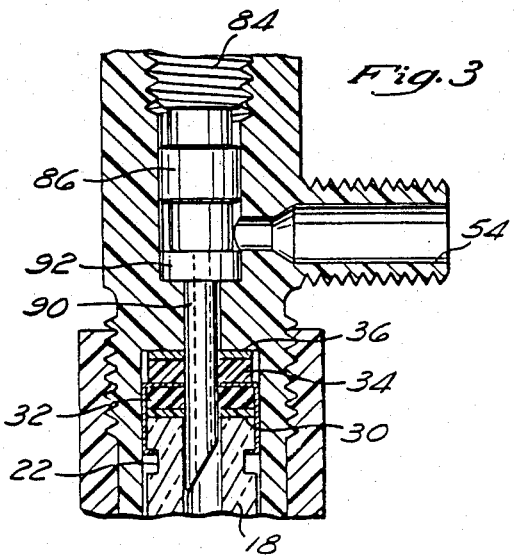

METHOD AND APPARATUS FOR PACKAGING, SHIPPING AND USING POISONOUS LIQUIDS

CROSS-REFERENCE TO RELATED APPLICATIONS

This is a continuation of U.S. patent application Ser. No. 188,089, now abandoned, filed Apr. 27, 1988, which is a continuation of U.S. patent application Ser. No. 944,189, now abandoned, filed Dec. 22, 1986, which is the U.S. National Phase filing of PCT Application No. PCT/US85/00925 filed May 17, 1985.

BACKGROUND OF THE INVENTION

This invention relates generally to a closure system for a container for shipping, storing and using toxic and corrosive liquid chemicals and particularly to a closure system for total sealing of ultra-high purity chemicals of the type used in manufacturing semiconductor and optical fiber devices.

It is well established that the successful manufacturing of semiconductor devices is dependent upon the use of high purity raw materials. Reliability improvements and improvements in basic physical parameters such as junction leakage, flat band voltage shift, minority carrier lifetime, etc., illustrate the necessity of maintaining a high degree of purity in raw materials. The yield of usuable components is also dependent upon raw material purity. Manufacturing of semiconductor devices is a high volume, low unit cost process. Competitive pressures result in drastic price erosion for a given semiconductor device until the high volume, low cost equilibrium state is achieved. Since the quality and device yield are highly dependent upon the purity of raw materials, the equilibrium, or profitable state, requires constant raw material purity.

The substances used in manufacturing semiconductor and optical fiber devices include phosphorus oxychloride, phosphorus trichloride, trichloroethane, tetraethyl orthosilicate, silicon tetrabromide, phosphorus tribromide, arsenic trichloride, etc. These chemicals are generally in liquid form and are hazardous to varying degrees. Therefore, they require a minimum or zero exposure to workers handling them.

In the U.S., such corrosive materials, class B poisons and the like, are subject to regulation by the Department of Transportation and other governmental agencies. Regulations, health and safety factors must be considered in shipping, storing and using these liquid materials.

In the semiconductor manufacturing industry, these chemicals are ordinarily removed from a container by passing an inert gas through the liquids. The gas becomes saturated with the vapors of the chemical by bubbling through the liquid. The gas exits the container, carrying the chemical vapors to a diffusion furnace or to a thin film reactor.

The standard container used for storing, shipping and using liquid chemicals in semiconductor and optical fiber fabrication is a bubbler produced by the assignee of the present invention and described in U.S. Pat. Nos. 4,134,514 and 4,298,037. The bubbler includes a generally cylindrical container that is partially filled with the liquid chemical and hermetically sealed to provide complete isolation of the chemical from the environment. The bubbler includes an inlet tube and an outlet tube. Each of the inlet and outlet tubes includes a quartz breakseal and an outer seal extending across the tube to prevent access to the container.

The bubbler is used by first breaking or removing the external or outer seals and connecting the inlet tube to a carrier gas supply and the outlet tube to a system to receive the chemical substance contained in the bubbler. Inlet and outlet shutoff valves are attached to the tubes, and the spaces between the inlet and outlet tubes between the respective valves and the inner breakable seals are then flushed with dry, clean inert gas to remove atmospheric moisture that may have collected there. The internal seals may then be broken.

Although the bubbler described above is satisfactory for maintaining the integrity of the ultra-high purity chemicals and protecting the environment from contamination, the bubbler is costly to manufacture, and the quartz breakseals are a considerable factor in the costs. Since at least the inner seal must be broken to remove the chemical from the bubbler container, the bubbler requires costly refurbishment for subsequent reuse.

Accordingly, there is a need in the art for a relatively simple and inexpensive bubbler closure to provide total containment of a corrosive chemical substance during storing, shipping and use. There is also a need in the art for a bubbler closure which eliminates the necessity of costly refurbishment before reuse, is simpler to manufacture and which simplifies the filling and sealing of the ultra-high purity chemical in the bubbler and facilitates safe handling of the bubbler and enclosed chemical.

SUMMARY OF THE INVENTION

The present invention comprises, in one form, a container for chemicals which must be protected from exposure to air and from inflow of gas or vapor through containment walls. The container is a vessel composed of gas and vapor-impervious material, typically quartz, nickel, or other material or combinations of materials which are chemically inert to the chemical to be contained therein. The vessel comprises at least one conduit extending therefrom, that conduit being in communication with the interior. Typically, vessels of the type under consideration have two or three conduits, typically two. Sometimes a conduits is used for filling and is not later used. The vessel may also include wells and other structure for measuring temperature, heating the chemical, etc., all of which are composed of chemically inert material, with respect to the contained chemical. The container also includes sealing means secured to the end of the conduit for closing off the end thereof and sealing the end against entry of air and vapor. The sealing means comprises a multiple layer sandwich of sealing materials which form a barrier to the introduction of air and vapor into the vessel. This sandwich of materials includes a first layer which is composed of a material which is chemically inert to the contained chemical. This first layer is characterized in that it is composed and constructed to be readily capable of being penetrated by sharp hollow needle. The first layer or bottom layer, in that it is in contact with the open end of the conduit and seals that end, is typically made of a noble metal, tantalum or a fluorocarbon polymer, such as polytetrafluoroethylene, sold under the trademark Teflon. The term polytetrafluoroethylene will be used here to generally describe this class of polymers, although there are variations in such fluorocarbon polymers. The second layer of the sealing means is composed of a resilient material, such as silicone rubber, butyl rubber, Viton synthetic rubber, Hycar synthetic rubber, Neoprene synthetic rubber, Kalrez synthetic polymer, all of which are generally referred to here as synthetic rubber polymers. These materials are characterized in that they are capable of being penetrated by sharp needle, and when penetrated they grip the outer circumference of the needle in a fluid-tight seal. Means are provided for securely fastening the sealing means on the end of the conduit in fluid-tight sealing relation thereto. Typically, a crimp, designed with a circular center hole and engaging in a groove or collar in the outer circumference of the conduit is provided as the fastening means for the sealing means, but any convenience fastening means may be used. Suitable adhesives, or potting compounds, for example, could be used.

In another embodiment, a two-layer sandwich composed of a first layer of chemically inert material is bonded to a second layer of resilient material and can be disposed on top of the seal fixed to the bubbler with the resilient layer juxtaposed to the resilient layer of the sandwich fixed to the bubbler and held in place by a valve used to gain access to the interior of the bubbler. This first layer may be of any of the inert materials mentioned and, typically, would be formed of polytetrafluoroethylene or an inert metal such as tantalum. The resilient layer may be substantially identical to the resilient layer of the bubbler closure.

A method of handling corrosive chemicals and chemicals in which ultra-high purity is essential or important also involves the filling of a container of the type described and the sealing of that container with the seal of the type described. In one form, the invention contemplates a container as described in combination with a valve mounted on the conduit in fluid-tight relationship therewith. The valve comprises a body having a passage therethrough which encloses the sealing means and also a passage communicating to an outside conduit. These two passages communicate with one another to permit introduction of high purity gas or fluid from the container. The body of the valve forms a valving passage which receives a valving member which seals the passage at one end. The valving member is mounted for movement in the valving passage to open and close the valve. A hollow needle having a sharp end formed on a free end, or one end, therefore, is also received in the valving passage. The valving body, valving member are so constructed, mounted with respect to each other and disposed that, upon movement of the valving member in the valving passage in a predetermined direction, the valving member forces the sharp point of the needle through the sealing means thereby opening a fluid path through the sealing means from the interior of the container to the valving passage. This enables introduction of fluid into or removal of fluid from the container. In one preferred embodiment of this combination, the needle is supported inside the valve passage by means which permit it to move reciprocally and seal against the walls of the valve passage.

In one view of the invention, a unique valve construction is provided. The valve comprises the body, having the passages described, the valving member and the needle, assembled and in combination with one another such that upon movement of the valving member in one direction, the needle is forced toward the pointed end thereof, thereby permitting the forcing of the needle, when the valve is in use, through a sealing means comparable to or the same as that previously described. The valve will, typically, include means for securing the valve on the end of a conduit, for securing conduits to the valve, etc., as is conventional in valve manufacture. One preferred form of this valve includes a disk secured to one end of the needle, the disk positioning the needle in the valve passage, sealing the valve passage, and maintaining the needle in position before, during and after use.

One form of the invention also contemplates a method of receiving a chemical of the type described in a container of the type described, fitting the valve to the container, moving the valving member and thereby opening the interior of the container to receive or to dispense fluid. It will be apparent from the foregoing discussion that there are many novel and high advantageous facets of the invention. The invention, thus, contemplates a new valve, a new container, a new sealing means, a new combination of these, and methods for using the same.

BRIEF DESCRIPTION OF THE DRAWINGS

FIG. 1 is a cross-sectional view of a bubbler container for corrosive liquid chemicals showing an inlet valve and an outlet valve connected thereto;

FIG. 2 is a cross-sectional view of the inlet and outlet valves showing the septum closure of the invention being retained between a stem extending from the bubbler container and a valve body; and FIG. 3 is a cross-sectional view illustrating the septa of FIG. 1 being penetrated by a needle in the valve body.

DESCRIPTION OF THE PREFERRED EMBODIMENT

In the following discussion, the invention will be described as a combination and as a method of using the combination and the various components thereof, it being understood that the individual components also have novelty, and that variations and adaptations of the concepts and principles of this invention may be made without departing from the scope thereof.

Reference is made first to FIG. 1 which depicts a complete container of the type contemplated by this invention. The container includes a vessel 10 which is made of a material which is inert to the chemical to be contained therein, which is impervious to gas and vapor, and which is sufficiently strong to permit reasonable handling and shipping. Such containers are typically made of quartz, but may be made of other materials. For example, in some utilizations the vessel may be made of nickel or tantalum. The vessel could, theoretically, also be made of a noble metal, but this would be unduly expensive. In some applications, the vessel could be made of a sandwich of multiple materials. For example, if suitable quality control and manufacturing assurance can be maintained, it would be possible to provide a container of metal-coated polymer, for example, nickel-coated polytetrafluoroethylene. Likewise, if suitable quality can be obtained, it would be possible to make it a container of a metal which need not be totally resistant to the chemical coated internally with polytetrafluoroethylene. Both of these approaches are attractive in concept but face the serious challenge that is very difficult if not impracticable to maintain quality assurance standards such that a risk of a leak or pin-hole or thin area in the polytetrafluoroethylene is totally avoided. The vessel includes at least one conduit extending therefrom and in communication with the interior thereof. One such conduit is shown at 12 which includes an extension 14 going near to the bottom of the vessel with an opening at the bottom of the extension conduit 14. This is used, typically, in a bubbler configuration for bubbling ultra-high purity gas through the chemical contained in the vessel and removing the vapor-laden gas from another conduit 18 which also communicates with the interior of the vessel. Vessels of this type are described in the aforementioned U.S. Pat., it being understood that FIG. 1 is somewhat simplified and schematically illustrates the vessel construction.

Taking the conduit 12 as typical of conduits which may be formed on the vessel as part of the container, such a conduit, preferably, is of a thick wall construction and has formed in the outer periphery thereof two annular grooves 20 and 22 or collars or one of each. The groove 20 is used to contact the valve, and the groove 22 is used to connect the sealing means, all as will be described in greater detail hereinafter.

The container also includes sealing means which is a sandwich arrangement comprised of layers 30 and 32 held in place by fastening means 40.

The layer 30 must be of a material which is chemically inert to the contained chemical. This may be made of a noble metal, a chemically resistant metal of a chemically resistant polymer. In addition to the noble metals, which form excellent seals but are very expensive, one may use tantalum which has a very high resistance to chemical attack from most chemical reagents. One may also use certain polymeric materials, generally referred to here as polytetrafluoroethylene or fluorocarbon polymers. A polymer of this type is sold under the trademark Teflon by Du Pont Chemical Company. Comparable or suitable fluorocarbon materials may be obtained from a number of sources. The fluorocarbon materials have the distinct advantage that they form excellent seals under pressure, in that they cold flow to conform to the configuration of the opening which they must seal. The metals also cold flow to some extent, but often greater force is required to form a tight seal. The noble metals and tantalum have the advantage that they are, for all practical purposes, totally impervious to gas, whereas, the fluorocarbon polymers are not totally gas impervious. For present purposes, however, where the area is small, and the thickness may be substantial and where a sandwich construction is used, fluorocarbon polymers may be considered as substantially gas and vapor impervious within the context and within the limitations of the present invention.

A second layer 32 is also provided. This layer is of a resilient sealing material, generally referred to here simply as synthetic rubber polymers. Silicone rubber, butyl rubber, Viton, Hycar, Neoprene, and Kalrez, among others, may suitably be applied in this invention. These materials are characterized in that they can be penetrated, and when penetrated, by a hollow needle for example, they seal around the outer circumference of the needle in a tight, substantially gas-impervious seal.

The bubbler sealing means comprising layers 30, 32 is securely fastened to the end of the conduit 12 and closes off the end of the conduit by a fastening means shown at 40. The fastening means, in the preferred embodiment, is a crimp fastener which has a portion extending around the periphery of layers 30, 32 and over a portion of the top surface of layer 32 of the sealing means and has another portion which is crimped and grips in the groove 22 holding the sealing means tightly in sealing relationship with the end of the conduit. The crimp fastener, typically, has an aperture through which the needle can extend when it penetrates the seal, as will be described hereinafter. By appropriate selection of materials, and thicknesses, it is also possible to use a crimping cap which covers the entire area over the second layer, thus providing a further gas and vapor barrier during handling. For example, a crimp made of nickel with a thinned center area on the top could be used as a gas barrier during transit, and as part of the sealing means.

In another embodiment, a second two-layer sandwich having layers 34 and 36 is placed on top of the closure (30, 32, 40) prior to fixing a valve assembly 50, or other withdrawal device, to the conduit 12 of bubbler or vessel 10. Layer 34 may be identical to the layer 30 and, normally, would be so. It may differ, in that it may be made of metal while the layer 30 is made of polymer, or, visa versa, the layer 30 may be made of metal while the layer 36 is made of polytetrafluoroethylene, for example. The purpose of the layer 36 is to provide a chemically inert outer or upper surface. As will be seen, if, in the combination, the valve does not totally seal around the needle, this surface may be exposed to the chemical contained in the vessel. Layer 34 is bonded to layer 36 and, typically, is the same or substantially identical to the layer 32, or at least has the same sealing, resilient characteristics, although it may be made of a different material.

The process of this invention includes filling the vessel with the chemical to be contained therein, in the absence or substantially absence of air or vapor which would react therewith or tend to contribute impurities thereto, and then sealing the vessel to provide the container as described with the sealing means a part thereof.

The combination of this invention also contemplates the assemblage of a valve, generally shown at 50, over the end of the conduit in a fluid-tight sealing relationship. The valve 50 includes a valve body 52 which has formed therein a conduit 54 to permit the introduction into or removal of fluid from a valving passage 56 which extends through the valve body. The passage 56 also has a threaded portion 58 and a reduced portion 60 which forms a shoulder with an enlarged portion 62. The enlarged portion 62 extends over the sealing means and is secured in place as will be described. The shoulder 64, between the portions 60 and 62 of the passage seals against the third layer of the sealing means, thus providing a gas-tight, chemically inert containment from the chemical to be contained in the vessel. The valve body has an exterior threaded portion 66 which threadably engages with a retaining nut 68, which has a portion 70 which extends into the groove 20. A gasket of ferrule 72 is provided to assure a totally gas-tight seal between the valve and the conduit, enclosing the sealing means within the valve passage. The valve also includes a valving member 80, in the preferred configuration, is generally elongate having an upper end 82 which may be in the form of a handle, hexagonal or square head, or in any other configuration to permit gripping and turning thereof. Also formed on the valving member are threads 84 which engage in a threaded portion 58 of the valve passage in the valve body. A sealing gasket 83, or an "O" ring seal, is expanded by the cap 85 against the shaft 80 forming a gas-tight seal. An enlarged portion 86 also seals against the walls of the valve passage when the valve is in use. By turning the valving member 82, it will move inwardly or outwardly, reciprocally, in the valving member. A very important and significant feature of this invention is the placement of a needle in the valving passage. The needle 90, typically, has a sharp end at one end, a free end, shown adjacent the sealing means. In the preferred embodiment, support means 92 is also provided. This support means centers the needle, holds it in position, and seals against the walls of the valving passage.

The combination having been described, can now be described insofar as its operation is concerned. Referring first to FIG. 2, the combination is formed, according to the method of this invention, by affixing the valve on the conduit in a gas-sealed relationship, as described. The valving member is then turned or otherwise actuated, and moved in a predetermined direction, downwardly as shown in FIG. 2. As it moves down, the needle 90 penetrates the sealing means comprising the two-layer (30, 32) closure fixed to conduit 12 and the two-layer (34, 36) sandwich disposed between the closure in conduit 12 and the valving passage 56. The full down position of the valve as shown in FIG. 3, which is a partial cross-section of that portion of the valve necessary to show the position of the needle. As is seen in FIG. 3, the needle penetrates through the sealing means and opens the conduit passage to the valving passage, thus permitting introduction into or removal of fluid to or from the vessel. Typically, the valving member would be withdrawn a small distance to permit fluid to flow from the vessel, through the needle, into the valve passage, and then through the communicating passage 54.

Thus, in one contemplation of the invention, the use of the invention receives a container, as described, affixes a valve, as described thereto, and operates the valve as described, thereby obtaining access to the chemical contained therein, or fills the vessel, as may be the purpose of the user.

As will be understood from the foregoing description, the septum is constructed as a sandwich, having a bottom layer of a totally inert material, such as a chemically compatible, non-reactive metal, for example, tantalum or a nobel metal and/or a fluorocarbon polymer, such as Teflon. The top layer of the sandwich should be made of a pliable, vapor impermeable, chemically compatible compound, such as silicone rubber, butyl rubber, Viton, Hycar, Neoprene, Kalraz, etc., which exhibits good sealing characteristics. The bottom layer of the septum should be the only layer exposed to the contained chemical. The septum itself is tightly attached to the stem with a crimp, designed with a circular center hold for unobstructed needle movement and optimum sealing characteristics.

The additional septum comprising layers 34, 36 placed on top of the crimp and septum arrangement, just described, facilitates additional upward sealing. The additional septum is held firmly in place with a simple protective plastic cap during storage or transportation, or with the valve when the bubbler is in use. In this arrangement, the secondary septum is placed with its inert side up, outwardly from the chemical and its sealing side down toward the crimp. In this fashion, the chemical is allowed only to contact inert material and thus its ultra-purity is maintained.

In accordance with one embodiment of the invention, two valves are supplied for controlling the flow of carrier gas in or out of the bubbler. The valves are considered the inlet and outlet ports of the bubbler and are manufactured of a material which is totally compatible with the ultra-high purity nature of the chemical, such as a fluorocarbon polymer, Teflon, for example. The valves used as the inlet or outlet are so called "two-way" valves, which are equipped with a movable, internal hollow needle to allow the carrier gas to pass through the needle. The needle is preferably made of quartz, noble metal such as platinum, tantalum, or fluorocarbon polymer-coated stainless steel. The top of the needle is attached to and oriented within the valve body with the help of a small needle support plate, typically made of quartz, noble metal, tantalum or fluorocarbon polymer, to facilitate proper directional guidance of the needle. The needle is made with a 90 degree cut across the top while the bottom tip has about a 22 degree bevel point for easy septum penetration, or a conical point and with a side port opening to facilitate septum penetration without septum cord cutting and possible contamination.

The valve is designed to allow the hollow needle to rest on the upper septum before opening. For use, the valve stem is rotated downwardly, which forces the needle to penetrate both septa. Following penetration, the valve stem is rotated upwardly to the stop, thus leaving the needle and support plate in its bottom location and clearing the opening of the valve chamber to facilitate the entry and exit of gases or fluids. Leakage to and from the outside is prevented through the upper internal valve seal and the sealing of the septum arrangement. The integrity of the ultra-high purity chemical is warranted by allowing the chemical to contact only totally inert materials, e.g. quartz, noble metal, tantalum or fluorocarbon polymer.

In review, while the invention embodies many structures and exhibits many features, the invention, in one embodiment, may be generally described as a bubbler container for containing and transporting ultra-pure corrosive and poisonous liquid reagents which must be protected from exposure to air and from transmission of gas or vapor through containment walls. The bubbler comprises a vessel 10 formed of a material which is inert to the poisonous liquid reagent, and which is a barrier to gas transmission, containing the liquid. At least one conduit 12, 18, provides fluid communication with the vessel. One such conduit, preferably, extends to a point proximate the bottom of the vessel, and the other conduit is an outlet for permitting outflow of the poisonous reagent. One or both of these conduits is sealed, the seal comprising a first layer 30 sealed in gas-tight relation to a conduit into the vessel closing the conduit opening, the first layer being composed of material which is chemically inert to the liquid to be shipped, stored and used in the container and being thin and capable of being penetrated by a sharp hollow needle. The seal also comprises a second layer 32 overlaying the first layer, the second layer composed of resilient material so composed and configured as, in use, to be readily capable of being penetrated by a sharp hollow needle and gripping said needle in fluid tight seal therewith. The first and second layers overlay one another to form an integral plural-layer seal. Means, such as the cap 40, securely fasten the layers over the inlet opening in fluid-tight sealing relation thereto. The bubbler container may, in shipment and in use, comprise a valve 50 mounted on said conduit in fluid-tight relation therewith enclosing said integral seal. In a preferred form, the vessel conduit defines in the exterior thereof a recess 22 for permitting engagement of the fastening means therewith, and the fastening means is comprised of a puncturable, gas-impermeable material capable of retaining a configuration into which it is bent or formed and which is inert to the poisonous liquid to be contained and is in the form of a cap comprising a generally planar top which overlays the outer surface of the second layer, defining a third layer over the second layer. The cap includes annular walls and means in the annular walls engaging the exterior recess of the inlet conduit for securing the fastening means and layers in gas-tight relationship with the conduit. A second seal or septum comprising layers 34 and 36 may also comprise the seal, and be disposed between the conduit and the valve passage in the manner described.

It will be understood that the foregoing is the preferred embodiment of the invention and that variations therein may be made without departing from the scope and content of this application of the concept of the invention.

INDUSTRIAL APPLICATION

This invention finds industrial application in the manufacture of semiconductor devices and, more particularly, in providing, shipping and handling doping and other chemical reagents for the semiconductor industry.

What is claimed:

1. A bubbler container for containing and transporting ultra-pure corrosive and poisonous liquid reagents which must be protected from exposure to air and from transmission of gas or vapor through containment walls, comprising in combination: a vessel formed of a material which is inert to the poisonous liquid reagent, and which is a barrier to gas transmission, for containing the liquid; a conduit forming at one end an opening into the vessel, the other end extending to a point proximate the bottom of the vessel; an outlet conduit for permitting outflow of the poisonous reagent; a first layer sealed in a gas-tight relation to a conduit into the vessel closing the conduit opening, the first layer being composed of material which is chemically inert to the liquid to be shipped, stored and used in the container and being thin and capable of being penetrated by a sharp hollow needle; a second overlaying the first layer, the second layer composed of resilient material so composed and configured as, in use, to be readily capable of being penetrated by a sharp hollow needle and gripping said needle in fluid tight seal therewith; the first and second layers overlaying one another to form an integral plural-layer seal; means securely fastening the layers over the inlet opening in the fluid tight sealing relation thereto.

2. The bubbler container of claim 1 wherein the two-layer integral seal closes and seals the inlet conduit, and wherein the bubbler further comprises: a valve mounted on said conduit in fluid-tight relation therewith enclosing said integral seal, said valve comprising a body having a valving passage therethrough which encloses the sealing means and a passage for communicating to an outside conduit in communication with the valving passage; a valving member received in the valving passage and sealing said passage; the valving member being mounted for reciprocal movement in the valving passage; a hollow needle having a sharp point formed on a free end thereof received in the valving passage; means supporting the needle in the valving passage for reciprocal movement in the valving passage; the valving body, valving member, support means and needle being so constructed, mounted and disposed that upon movement of the valving member in the valving passage in a predetermined direction in valving passage forces the sharp point of the needle through the layers thereby opening a fluid path through the layers from the valving passage to the vessel; the valve body, needle and support means being composed of material which is chemically inert to the liquid to be shipped, stored and used in the container; the vessel, conduit and valve being so constructed as to cause gas introduced to the valve to flow through the conduit into the liquid to be shipped, stored and used in the container for substantially saturating the gas with vapor of the liquid to be shipped, stored and used in the container and to permit the saturated gas to flow from the vessel through the outlet opening.

3. The bubbler container of claim 2 wherein the inlet conduit contains in the exterior thereof a recess for permitting engagement of the fastening means therewith, and wherein the fastening means is comprised of a puncturable, gas-impermeable material capable of retaining a configuration into which it is bent or formed and which is inert to the poisonous liquid to be contained and is in the form of a cap comprising a generally planar top which overlays the outer surface of the second layer, defining a third layer over the second layer, annular walls, and means in the annular walls engaging the exterior recess of the inlet conduit for securing the fastening means and layers in gas-tight relationship with the conduit.

4. The bubbler container of claim 3 wherein the fastening means is formed of puncturable metal which is gas impermeable and inert to the poisonous liquid to be contained and the means engaging the exterior of the inlet conduit comprise crimped metal portions of the walls of the fastening means.

5. The bubbler container of claim 1 further comprising: a second septum comprising a first layer overlaying a second layer, the first of the second septum layer being composed of material which is chemically inert to the liquid to be shipped, stored and used in the container and being thin and capable of being penetrated by a sharp hollow needle, the second septum being disposed on top of the two-layer closure of said bubbler container.

6. The bubbler container of claim 1 wherein the two-layer integral seal closes and seals the inlet conduit, and wherein the bubbler further comprises: a valve mounted on said conduit in fluid-tight relation therewith enclosing said integral seal, said valve comprising a body having a valving passage therethrough which encloses the sealing means and passage for communicating to an outside conduit in communication with the valving passage; a valving member received in the valving passage and sealing said passage; the valving member being mounted for reciprocal movement in the valving passage; a hollow needle having a sharp point formed on a free end thereof received in the valving passage; means supporting the needle in the valving passage for reciprocal movement in the valving passage; the valving body, valving member, support means and needle being so constructed, mounted and disposed that upon movement of the valving member in the valving passage in a predetermined direction in valving passage forces the sharp point of the needle through the layers thereby opening a fluid path through the layers from the valving passage to the vessel; the valve body, needle and support means being composed of material which is chemically inert to the liquid to be shipped, stored and used in the container; the vessel, conduit and valve being so constructed as to cause gas introduced to the valve to flow through the conduit into the liquid to be shipped, stored and used in the container for substantially saturating the gas with vapor of the liquid to be shipped, stored and used in the container and to permit the saturated gas to flow from the vessel through the outlet opening.

7. The bubbler container of claim 1 further comprising a second septum or closure having two layers overlaying each other with a layer composed of resilient material so composed and configured as, in use, to be readily capable of being penetrated by a sharp hollow needle and gripping said needle in fluid-tight seal therewith, said layer disposed adjacent said closure in said bubbler container; and another layer bonded to said layer of resilient material and composed of material which is chemically inert to the liquid to be shipped, stored and used in the container and being thin and capable of being penetrated by a sharp hollow needle.

8. A method of packaging and transporting ultra-pure corrosive and poisonous liquid reagents which must be protected from exposure to air and from transmission of gas or vapor through containment walls, comprising the steps of: introducing said poisonous liquid in vessel which comprises at least one conduit extending thereinto, the vessel being formed of a gas and vapor barrier material which is inert to the poisonous liquid reagent; sealing the external end if said conduit by closing the conduit with a first layer sealed in gas-tight relation to said conduit, the first layer being composed of material which is chemically inert to the liquid to be shipped, stored and used in the container and being thin and capable of being penetrated by a sharp hollow needle, overlaying the first layer with a second layer composed of resilient material so composed and configured as, in use, to be readily capable of being penetrated by a sharp hollow needle and gripping such needle in fluid-tight seal therewith, the first and second layers overlaying one another to form an integral plural-layer seal; and securely fastening the layers over the inlet opening in fluid-tight sealing relation thereto; and shipping the container to a point of use of the liquid therein.

9. The method of claim 8 wherein the step of sealing the conduit further comprises: forming in the exterior thereof a recess; forming a puncturable, gas-impermeable cap of a material which is capable of retaining a configuration into which it is bent or formed and which is inert to the poisonous liquid to be contained; overlaying the outer surface of the second layer with a planar top portion of the cap to thus define a third layer over the second layer; and the fastening step comprises deforming portions of the walls of the cap to engage in exterior recess of the inlet conduit thereby securing the layers in gas-tight relationship with the conduit.

10. The method of claim 8 further comprising disposing a second septum or closure on said first and second layers disposed over said conduit, said second septum or closure being a first layer adjacent said conduit closure comprising a resilient material and a second layer of material chemically inert to the liquid to be shipped bonded to said first layer.

11. A method of using a bubbler of ultra-pure corrosive and poisonous liquid reagents which must be protected from exposure to air and from transmission of gas or vapor contained in a vessel which forms at least one conduit thereinto and being formed of a material which is inert to the poisonous liquid reagent and impermeable to vapor and gas, the vessel being sealed with an integral seal closing the conduit, the seal comprising at least a first layer sealed in gas-tight relation to said conduit, closing the conduit opening, the first layer being composed of material which is chemically inert to the liquid to be shipped, stored and used in the container and being thin and capable of being penetrated by a sharp hollow needle, and a second layer overlaying the first layer, the second layer composed of resilient material so composed and configured as, in use, to be readily capable of being penetrated by a sharp hollow needle and gripping said needle in fluid-tight seal therewith, the first and second layers overlaying one another to form said integral plural-layer seal closing the conduit, comprising the steps of: mounting a valve on said conduit and over said seal in fluid-tight relation with the conduit, said valve comprising a body having a valving passage therethrough which encloses the sealing means and a passage for communicating to an outside conduit in communication with the valving passage, and moving a valving member received in the valving passage to apply force to a hollow needle having a sharp point formed on a free end thereof received in the valving passage forcing the sharp point of the needle through the layers thereby opening a fluid path through the layers from the valving passage to the vessel; the valve body, needle and support means being composed of material which is chemically inert to the liquid in the container.

* * * * *